US007832265B1

(12) United States Patent
Gong

(10) Patent No.: US 7,832,265 B1
(45) Date of Patent: Nov. 16, 2010

(54) VERTICAL WIND TUNNEL SPORTS ARENA

(76) Inventor: Stewart Gong, 2816 Buckminster Dr., Elk Grove, CA (US) 95758

( * ) Notice: Subject to any disclaimer, the term of this patent is extended or adjusted under 35 U.S.C. 154(b) by 39 days.

(21) Appl. No.: 12/316,936

(22) Filed: Dec. 19, 2008

(51) Int. Cl.
*G01M 9/00* (2006.01)

(52) U.S. Cl. ..... 73/147

(58) Field of Classification Search ..... None
See application file for complete search history.

(56) References Cited

U.S. PATENT DOCUMENTS 5,099,685 A * 3/1992 McLean et al. ..... 73/147
6,083,110 A * 7/2000 Kitchen et al. ..... 472/49
7,028,542 B2 * 4/2006 Metni ..... 73/147
7,234,348 B2 * 6/2007 Spampinato et al. ..... 73/170.01
2006/0025227 A1 * 2/2006 Metni et al. ..... 472/137

* cited by examiner

*Primary Examiner*—Andre J Allen

(57) ABSTRACT

A sports arena comprised of a vertical wind tunnel modular unit capable of conjoining with a multitude of vertical wind tunnel modular units joined in tandem for the purpose of levitating humans in a sports arena. The vertical wind tunnel sports arena is designed so that a single vertical wind tunnel modular unit can be utilized as a self contained sports arena or multiple vertical wind tunnel modular units can be combined together in tandem to form an expansive arena where various competitive sports can be played while the athletes are levitating in mid air. The arena contains two separate target systems, each suspended twenty feet above a trampoline safety net, disposed at polar opposite ends of the sports arena. A ball striking a button in the middle of a backboard on the target system will cause a fireball or Tesla coil report to discharge indicating a field goal.

5 Claims, 2 Drawing Sheets

VERTICAL WIND TUNNEL SPORTS ARENA

FIELD OF THE INVENTION

The present invention relates to a new combination of a vertical wind tunnel modular unit that is a self contained sports arena and is capable of conjoining with multiple vertical wind tunnel modular units to form an expansive sports arena that is capable of levitating human players. The present invention also relates to a new combination of a vertical wind tunnel sports arena and a field goal target system designed to register a successful field goal with a discharge of electrical bolts or an eruption of a fireball when a ball successfully strikes each respective target. The target system consists of a backboard with an activation button in the middle of the backboard. The activation button is designated as the target of the field goal. A thrown ball, which strikes the activation button, will cause an electrical discharge from a Tesla coil or a ball of fire to erupt from the nozzle of a propane flamethrower. Two opposing teams compete for possession of a ball, which they must throw at the activation button in the middle of a backboard, which is suspended twenty feet in height. The two field goal target systems are hung at opposite ends of the wind tunnel sports arena.

A horizontal trampoline safety net is suspended and tensioned on a steel frame serves as a horizontal playing surface of the wind tunnel sports arena. The mesh size of the trampoline safety net is large enough to allow the air from the wind column to pass through the net and levitate the players in mid air. When the players fall off the wind column, the trampoline serves as a safety net to cushion the falls.

BACKGROUND OF THE INVENTION

Known in the art of sky diving simulators are two types of designs for vertical wind tunnels. The first type of sky diving simulator is the enclosed circulating wind tunnel. The person levitating in the air column is enclosed in a cylindrical enclosure that allows air to pass through. The wind is generated by a motor and fan and the moving air is circulated in an enclosed loop. The second type of vertical wind tunnel used in a sky dive simulator is the open-air wind column, which levitates a person over a rotating fan. A steel mesh screen is placed between the fan and the flyer so that the flyer does not fall into the rotating blades of the fan. The wind is of sufficient force to levitate a human and is not circulated, but allowed to dissipate into the atmosphere.

While vertical wind tunnels capable of levitating humans are known in the art, these vertical wind tunnels are limited to a flying area of between six feet to fourteen feet in diameter. The present invention relates to a new combination of multiple vertical wind tunnel modular units linked together in tandem to form an expansive flying arena. A single vertical wind tunnel modular unit is capable of generating a vertical wind column of about ten feet in diameter. Any number of vertical wind tunnel units can be conjoined in tandem to form a flying area of indeterminate length.

Vertical wind tunnels capable of levitating humans in mid air have not been combined with a field goal target system for playing competitive sports in the wind column. The present invention utilizes a field goal target system that is suspended twenty feet above the flying arena. The field goal target system has a backboard with an activation button in the middle. When a thrown ball successfully strikes the activation button, the force of the thrown projectile will activate a Tesla coil which discharges bolts of electricity into the air. The activation button can alternatively be connected to a flamethrower, that when activated will cause the discharge of a fireball into the atmosphere, thus registering a successful field goal.

Vertical wind tunnels are primarily designed to train skydivers and to simulate a skydiving experience. The present invention significantly improves the utility and entertainment value of vertical wind tunnels. The present invention comprises a new tandem array to create a longer and more expansive flying area. The wind tunnel sports arena includes the innovation of a field goal target system that registers a successful field goal with the eruption of a pyrotechnic fireball or an electrical discharge from a Tesla coil.

SUMMARY OF THE INVENTION

The principle object of the present invention is to provide a vertical wind tunnel sports arena that utilizes multiple vertical wind tunnel modular units positioned in tandem to create an expansive flying arena capable of levitating human players for the purpose of playing competitive team sports. A primary purpose of the present invention is to provide an arena that employs a single self contained vertical wind tunnel unit or multiple vertical wind tunnel units conjoined in tandem to levitate opposing players in mid air while they compete for the possession of a ball. The vertical wind tunnel modular units are positioned so that the fan blades which generate the wind column are in close proximity so that a levitating player can fly between the first vertical wind column to the next successive vertical wind column. The proximity between the two fan blades of each vertical wind tunnel can be from six inches to two feet apart. The flying area of the arena can be lengthened and expanded by positioning any number of vertical wind tunnel modular units in tandem to one another. The number of wind tunnel units conjoined determines the length of the wind tunnel sports arena. The employment of an array of leveling jacks strategically positioned on the lower frame of each wind tunnel unit is utilized to form a level and plum playing field. A trampoline safety net is suspended and tensioned on a rectangular steel frame running the length and width of the flying arena. The trampoline safety net serves to cushion the falls of the levitating players and also to serve as a rebound service.

Another object of the present invention is the employment of a Tesla coil field goal target system that will discharge a highly visible array of electrical bolts into the atmosphere from a Tesla coil when a ball strikes the activation button on the backboard of the target system. The visible discharge of electrical bolts into the atmosphere signifies that a field goal has been registered. The Tesla coil field goal target system is suspended twenty feet in height above the trampoline safety net. The Tesla coil field goal target system is positioned at the end of the playing field defined by the dimensions of the trampoline safety net.

Yet another object of the present invention is the employment of a flamethrower field goal target system that will discharge fireballs into the atmosphere when a ball strikes an activation button located in the middle of a backboard. The second backboard is suspended twenty feet in height above the trampoline safety net. When a thrown ball successfully strikes the activation button on the backboard, the force of the ball will activate a switch that will cause a highly visible fireball to discharge from the nozzle of a flamethrower, signifying that a score has been registered. The flamethrower field goal target system is positioned at the polar opposite end of the Tesla coil field goal target system.

The present invention is capable of multiple configurations utilizing a single vertical wind tunnel modular unit or multiple vertical wind tunnel modular units and is capable of generating a 90 to 120 mph vertical column of wind. This vertical column of wind is capable of levitating a human player. A trampoline safety net is suspended and tensioned around a steel frame and is positioned between the fan blades and the levitating players. The trampoline safety net serves to cushion the falls of players who fall off the air column and the secondary purpose of the trampoline safety net is to serve as a rebound surface for the levitating flyers. The two field goal target systems are suspended twenty feet in height above the trampoline safety net on polar opposite sides of the playing field.

Although the present invention has been described with reference to preferred embodiments, numerous modifications and variations can be made and still the result will come within the spirit and scope of the invention. No limitations with respect to the specific embodiments disclosed herein is intended or inferred.

DESCRIPTION OF THE PREFERRED EMBODIMENT

Figure 1:
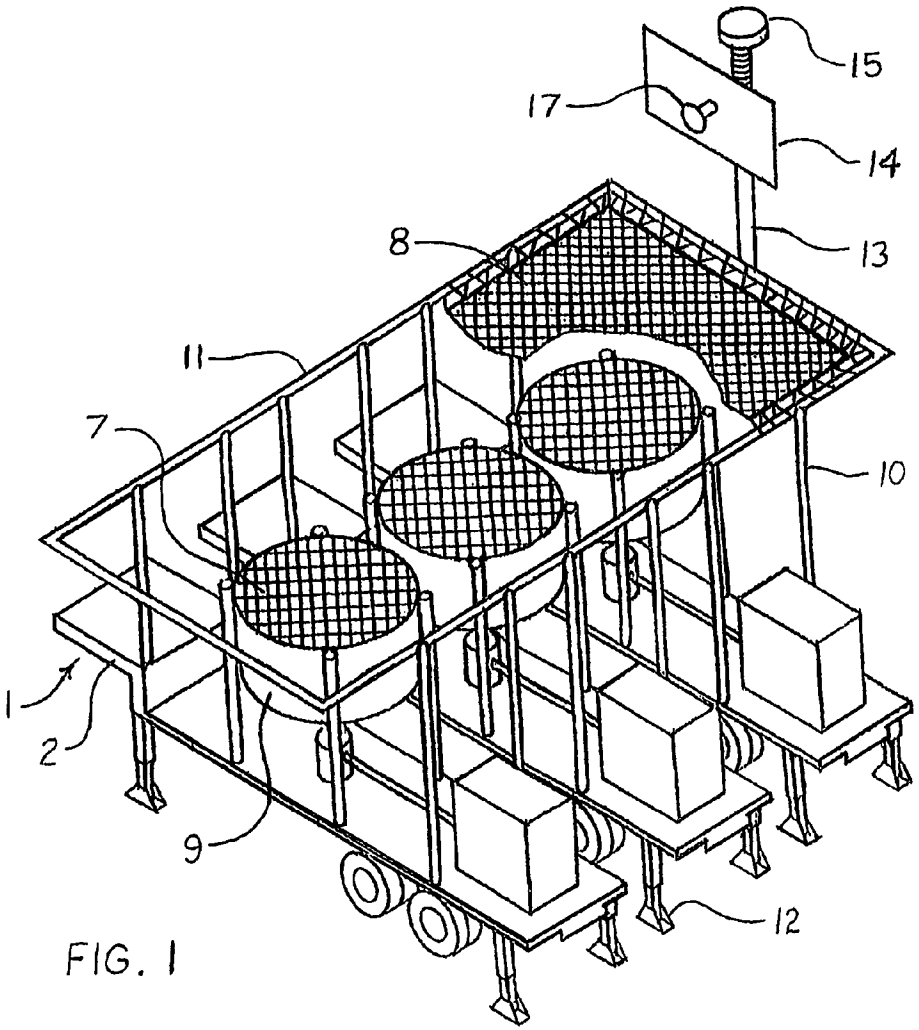
FIG. 1 is perspective view of the preferred embodiment of the vertical wind tunnel sports arena.

Referring first to FIG. 1 are three vertical wind tunnel modular units 1 parked adjacent to one another. Any number of vertical wind tunnel modular units 1 can be combined to form a vertical wind tunnel sports arena of indeterminate length. Vertical wind tunnel modular unit 1 can be transported to different locations by 50-foot trailer 2. Air flow duct 9 of each vertical wind tunnel sports arena modular unit 1 is spaced about 6 inches to two feet apart so that players can fly across the adjacent wind columns creating an uninterrupted flying area whose length is determined by the number of modular units 1 that are parked adjacent to one another. Steel wire safety grid 7 prevents players from falling into the rotating propeller. Trampoline safety net framework 11 and trampoline safety net 8 is adapted to accommodate the expansion of the flying area and is supported by vertical beams 10. Trailer 2 utilizes leveling jacks 12 to vertically raise or lower trampoline safety net framework 11 and trampoline safety net 8 until they are level to the horizon. When a ball strikes activation button 17, electrical bolts are discharged from Tesla coil 15. If the thrown ball misses the activation button 17, the balls will rebound off backboard 14. The Tesla coil target system is suspended by support pole 13 is deployed at the end of the sports arena.

Figure 2:
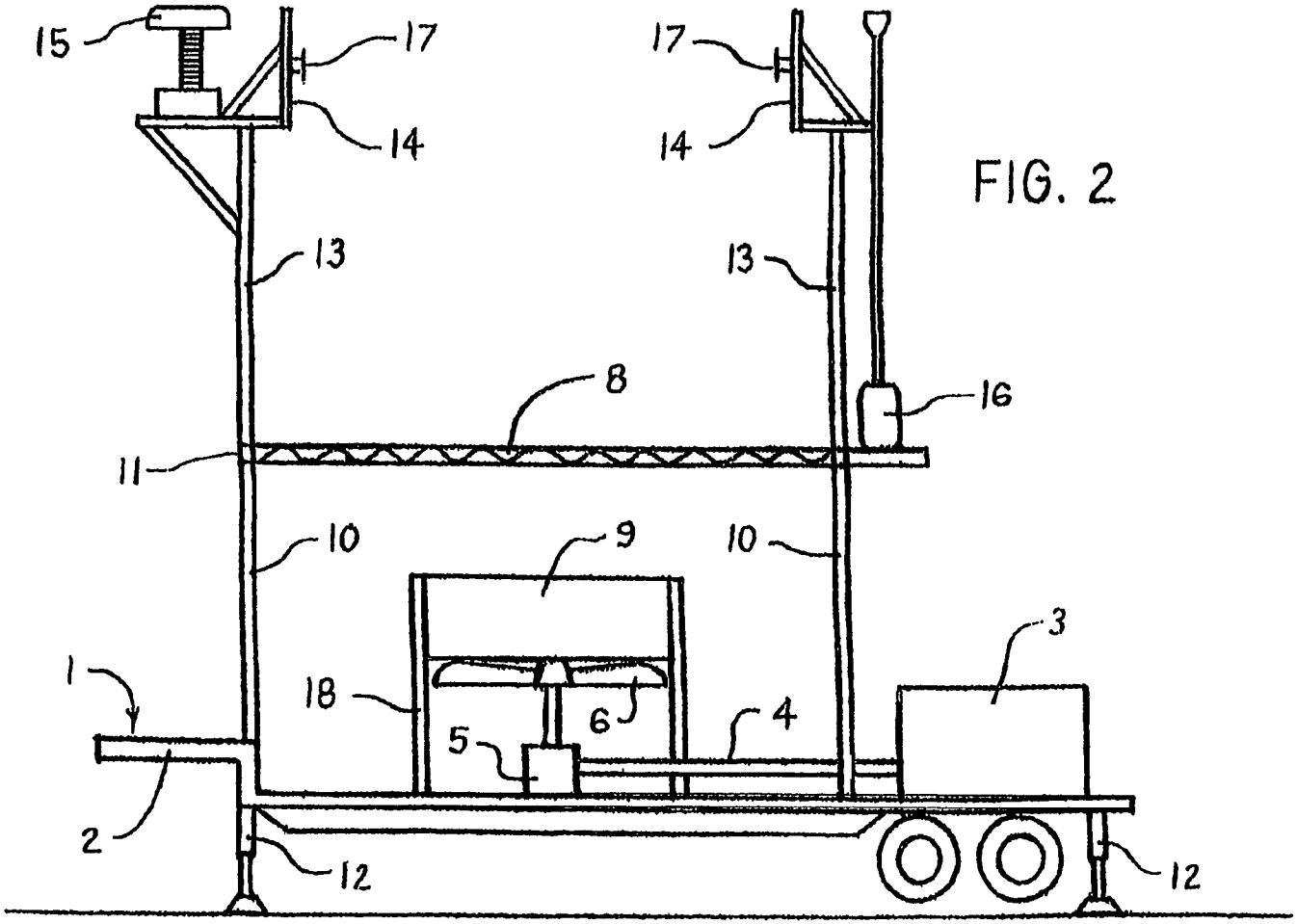
FIG. 2 is a front elevation view of the vertical wind tunnel modular unit.

Referring next to FIG. 2 is a vertical wind tunnel sports arena modular unit 1 which is comprised of a 50 ft. trailer 2 with diesel engine 3 that is coupled by drive shaft 4 to a right angle gear box 5 that is coupled to propeller 6. Diesel engine 3 supplies power to propeller 6 which generates a vertical column of wind with a velocity of about 90 to 120 mph through radial vanes in air flow duct 9 which contains vanes that straightens out the turbulent flow of air generated by propeller 6. Airflow duct 9 is supported by duct support beams 18. Trampoline safety net 8 is utilized to absorb the impact of players who fall off the wind column. Vertical beams 10 support trampoline safety net frame work 11 and is configured to be disassembled and reassembled onto trailer 2. Trampoline safety net 8 is tied and tensioned onto trampoline safety net framework 11. Leveling jacks 12 are mounted in the lower four corners of the trailer 2 to help facilitate a level and plumb playing field. Support poles 13 support backboard 14 and Tesla coil 15 and also propane flamethrower 16. Activation buttons 17 are utilized to activate Tesla coil 15 and propane flamethrower 16.

I claim:

1. A vertical wind tunnel sports arena comprising:

a single vertical wind tunnel modular unit having a wind column that levitates a human;

said vertical wind column modular unit is which conjoins identical vertical wind column modular units forming an expansive levitation arena to allow said levitating human to be displaced across each successive wind column;

said levitation arena is further comprised of a horizontal trampoline safety net forming the boundaries of the levitation arena;

first and second field goals are disposed at polar opposite ends of said trampoline safety net;

a Tesla coil report connected to the first field goal target system, wherein the Tesla coil report indicates when a user engages the first field goal target with a ball;

a propane flame thrower report connected to the second field goal target system, wherein the propane flame thrower report indicates when a user engages the second field goal target with said ball.

2. The vertical wind tunnel sports arena of claim 1, wherein leveling jacks are located at the four lower corners of the vertical wind tunnel modular unit so that incremental adjustments can be made to form an array of multiple units that are level to the horizon when they are joined in tandem.

3. The vertical wind tunnel sports arena of claim 1, wherein a trampoline safety net is suspended and tensioned on a steel frame defining rectangular shaped boundaries of a horizontal playing area.

4. The vertical wind tunnel sports arena of claim 1, wherein the first field goal target system is comprised of an activation button in the middle of a backboard that is utilized to activate a visible electrical discharge from a Tesla coil when a thrown ball strikes the activation button.

5. The vertical wind tunnel sports arena of claim 1, wherein the second field goal target system is comprised of an activation button in the middle of a backboard which is utilized to activate the discharge of a fireball from a flamethrower into the atmosphere when the activation button is struck by said thrown ball.

* * * * *